United States Patent [19]

Buffet

[11] 4,285,462

[45] Aug. 25, 1981

[54] CENTRIFUGES WITH HYDRAULIC CONTROLS

[75] Inventor: Denis Buffet, Meyzieu, France

[73] Assignee: Robatel S.L.P.I., Genas, France

[21] Appl. No.: 102,473

[22] Filed: Dec. 11, 1979

[30] Foreign Application Priority Data

Jan. 9, 1979 [FR] France ..... 79 01169

[51] Int. Cl.[3] ..... B04B 1/14

[52] U.S. Cl. ..... 233/20 A

[58] Field of Search ..... 233/21, 20 A, 20 R, 233/19 A, 19 R, 1 A, 1 R, 46, 47 R

[56] References Cited

U.S. PATENT DOCUMENTS

| | | | |
|---|---|---|---|
| 2,662,687 | 12/1953 | Spross | 233/21 |
| 3,630,431 | 12/1971 | Yokohama et al. | 233/20 A |
| 3,765,599 | 10/1973 | Hemfort | 233/20 A |
| 4,054,244 | 10/1977 | Paschedag | 233/20 A |
| 4,243,172 | 1/1981 | Buffet | 233/20 A |

*Primary Examiner*—Philip R. Coe

*Attorney, Agent, or Firm*—Dowell & Dowell

[57] ABSTRACT

The present invention relates to a centrifuge with a turbine system for hydraulic control and the like, wherein the system comprises an annular member having a groove mounted to slide in a housing hollowed in the lower face of the bowl 4, this groove member being fast with a support wedged on the conical bearing surface of the shaft. The liquid arrives through the ports in a plate whose ports discharge into the groove. The liquid injected in 14 raises a movable bowl member and uncovers the ports for draining the sludge from the bowl. By overflow, a drain valve is suppled of the groove into another hydraulic path with liquid to open the bowl. The bowl 4 may thus be withdrawn from the shaft by being lifted without dismantling of its lid. The invention is applicable to centrifuges with hydraulic controls.

6 Claims, 4 Drawing Figures

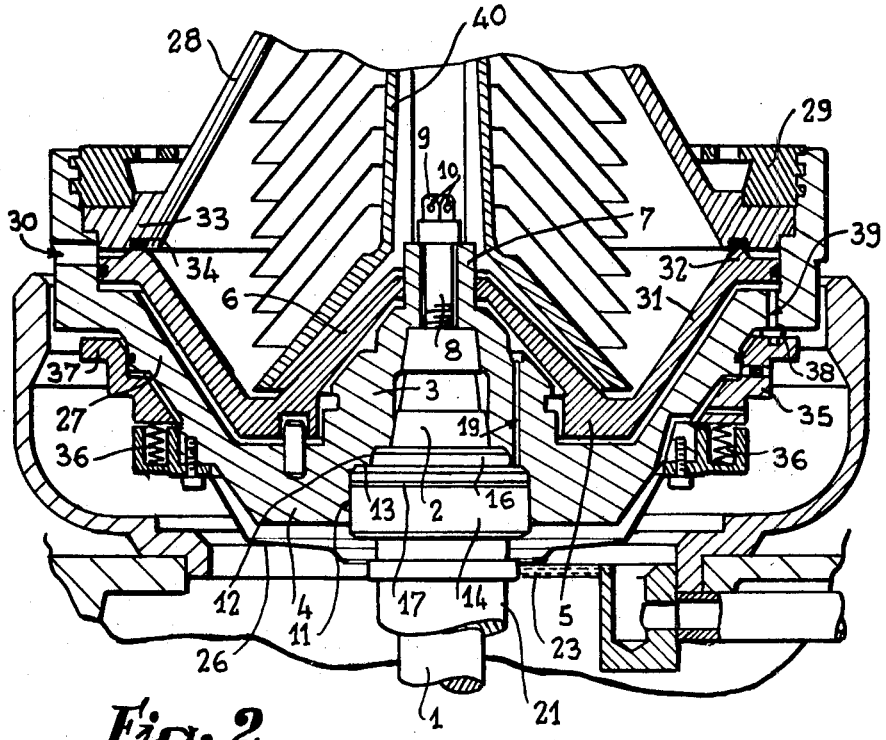
Fig. 2
Fig. 3
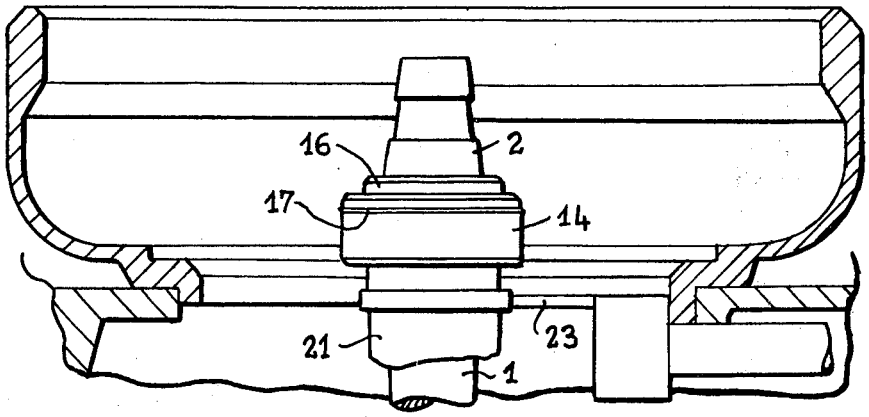

CENTRIFUGES WITH HYDRAULIC CONTROLS

The present invention relates to centrifuges equipped with hydraulically controlled devices associated with the rotating unit.

It is known for example that, in certain centrifuges, the bowl comprises a base closed by a lid, outlet ports being arranged in the zone of connection between these two parts. These ports are normally closed by needle valves or, better, by a movable inner base which is normally applied against the lid, but which may descend to reveal said ports. Means must obviously be provided for controlling the needle valves or the movable inner base. A simple solution consists in using, to this end, a hydraulic system, the pressure of the liquid resulting wholly or partly from the centrifugal acceleration.

The control liquid may be conveyed through channels pierced in the shaft of the centrifuge, but this considerably complicates the construction. It is therefore preferred, most often, to use for this purpose a fixed radial pipe which opens out opposite an inwardly opening annular groove formed in the rotating unit. The pipe may in particular penetrate in the groove so that it is located inside the liquid annulus entrained therein, this producing an appreciable counter-pressure at the opening of said pipe. The liquid may thus be supplied when it is under a pressure lower than said counter-pressure, in which case the groove does not overflow, or, on the contrary, when under a stronger pressure provoking the overflow, the excess liquid will be collected by an auxiliary groove to provide a desired actuation. This system, often called "turbine", thus ensures considerable flexibility of control.

However, this arrangement is disadvantageous in that it is no longer possible to have access to the turbine system without an extensive dismantling operation, since the pipe engaged in the groove prevents the rotating unit from being withdrawn from the shaft which carries it by simple lifting. Now, this dismantling is often very difficult.

It is an object of the present invention to remedy this drawback.

In accordance with the invention, the control liquid receiving groove of the turbine system is formed in an annular member slidably mounted in a central bore extending upwardly from the lower face of the bottom of the bowl rotating so that the latter may be lifted without taking said annular member with it, the latter being retained by the plate forms the opening of the liquid inlet pipe.

Of course, liquid tight means are provided for connecting the groove to a corresponding channel provided in the bottom of the bowl. According to another feature of the invention, the grooved member is connected with an annular support which is mounted on the base of a conical bearing surface of the shaft which supports the bowl and the groove communicates with the intermediate space made between this support and the lower face of the bowl, the above-mentioned channel also opening in said space. This arrangement not only ensures the desired connection, but in addition it couples to the hydraulic pressure which prevails in the intermediate space tending to push the support downwardly, i.e. to wedge it more tightly on the conical bearing surface, this preventing any untimely rotation of the grooved member in its housing.

The invention will be more readily understood on reading the following description with reference to the accompanying drawings, in which:

FIG. 2 is a view on a smaller scale showing other parts of the centrifuge.

FIG. 3 shows the centrifuge after the rotary bowl has been removed, the turbine system remaining in place.

Figure 1:
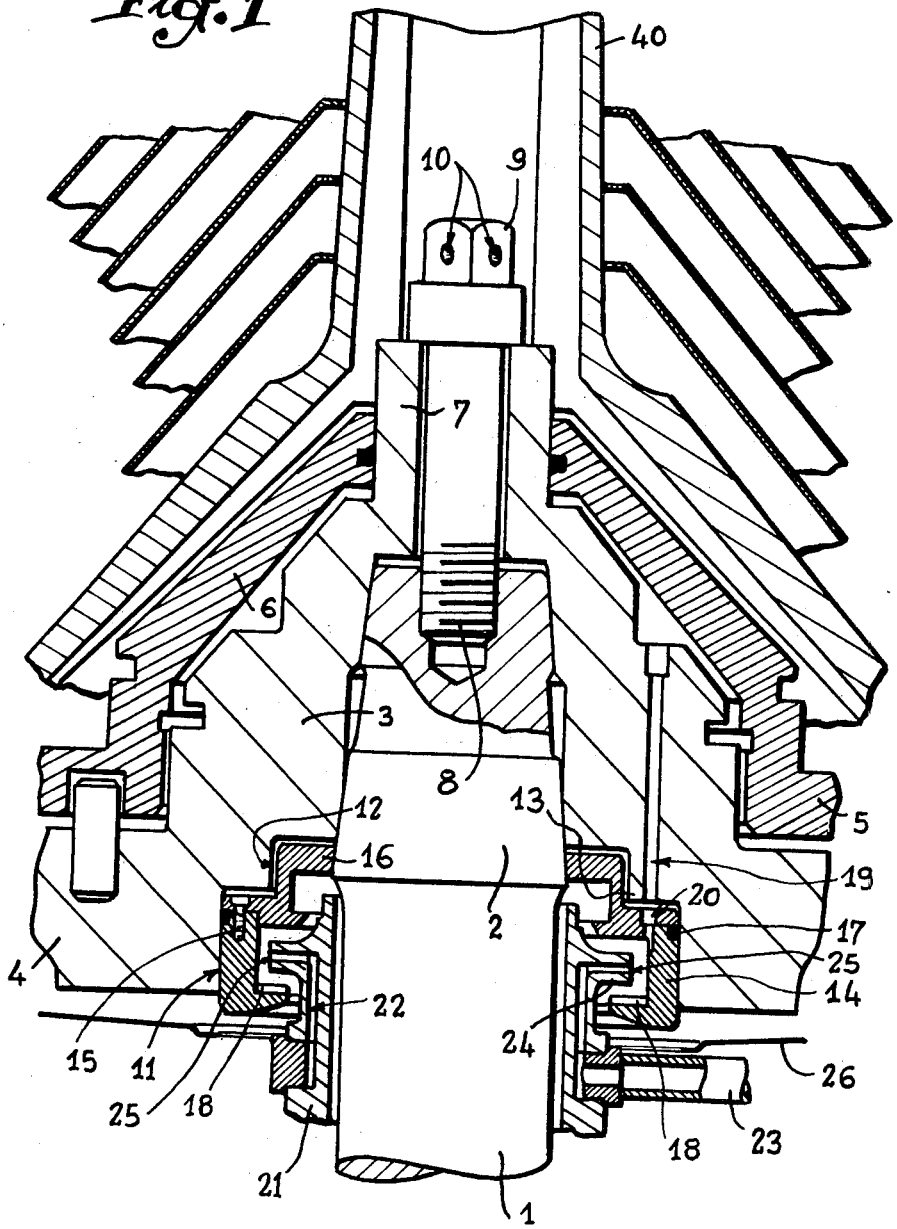
FIG. 1 is a part section on a large scale which shows the central part of a centrifuge according to the invention.

Referring now to the drawings, FIG. 1 shows at 1 the shaft of the centrifuge with its terminal conical bearing surface 2 on which the hub 3 of the bowl is mounted, which is integral with the main base 4 of the latter (vertically stationary base). The base 4 is lined by an inner base 5 (vertically movable base) integral with a conical hub 6 which slides tightly on a cylindrical extension 7 of the hub 3 of the bowl. This hub 3 is fixed in place on the conical bearing surface 2 by a screw 8 having a hexagonal head 9 having impressions 10 due to which said screw may be extracted upwardly through the usual axial pipe 40 for conveying the product to be treated, after the screw 8 has been unscrewed with the aid of a suitable wrench without it being necessary to dismantle the lid of the bowl beforehand.

A cylindrical housing has been hollowed in the lower face of the assembly of the base 4 and its hub 3, said housing comprising a larger part 11 and a terminal part 12 of smaller diameter than the preceding one, connected thereto by a shoulder 13. In the housing 11–12 thus made is engaged an annular member 14 which screws 15 secure to annular support 16. This member 14 is formed with an inwardly opening groove which opens toward the axis of the machine. The member 14 slides with reduced clearance in the large-diameter part 11 of the housing, the tightness being ensured by a seal 17. The annular support 16, in the form of an inverted cup, is disposed in the small-diameter part 12, its central opening of conical section being supported on the conical bearing surface 2 of the shaft 1 below the hub 3, whilst its lower flange is for assembly with the grooved member 14 which after assembly constitues at the same time the upper edge of the groove. As shown, the support 16 makes a certain clearance between its outer wall and that of the housing.

It will be noted that the lower edge of the groove of member 14 carries vanes 18 intended to rotate the liquid.

From the shoulder 13 proceeds a vertical channel 19 pierced in the mass of the hub 3 and which opens on the upper face thereof, below the hub 6 of the inner base 5 of the bowl, i.e. into what is conveniently called the control chamber of this base 5. Passages such as 20, provided in the upper edge of the groove of member 14 and in the flange of the support 16, cause the periphery of the groove to communicate with the space or clearance made between this flange and the shoulder 13, i.e. with the channel 19.

Below its conical bearing surface 2, the shaft 1 is surrounded, with clearance, by a sleeve 21 supported in fixed relationship by the frame of the machine (this frame not being shown in FIG. 1 in order not to overload the drawing). The sleeve 21, which in fact is composed of a plurality of parts suitably assembled by screwing, comprises in its thickness a chamber 22 into which a lateral pipe 23 opens. The sleeve 21 rises through the groove of member 14 and it supports a sort of annular plate 24 which engages radially therein, stopping at a short distance from its periphery. This plate 24 is pierced with radial ports 25 which communicate with the top of the chamber 22.

Below the lower face of the base 4 of the bowl (vertically stationary base), there is located a circular plate 26 adapted to form with said face an auxiliary groove for collecting the liquid overflowing from the groove of member 14 or main groove.

Referring now to FIG. 2, the actual bowl 27 is closed by a lid 28 maintained in position in the lateral wall of the bowl 27 by a portion of the wall just below the lid 28. The inner base 5 extends at 31 parallel to the lateral wall of the bowl and, in normal operation, its upper edge 32 bears against the lower face of the edge 33 of the lid 28 compressing a seal 34, thus isolating the ports 30 from the inside of the bowl which, on the contrary, become uncovered when said base 5 is lowered.

The plate 26 guides the liquid that it collects to a valve device comprising a ring 35 urged upwardly by springs 36 and the upper edge 37 of the ring bears seals 38 in the form of pellets applied against the opening of drainage channels 39 pierced in the wall of the bowl in the immediate vicinity of the inner periphery of said wall.

Figure 4:
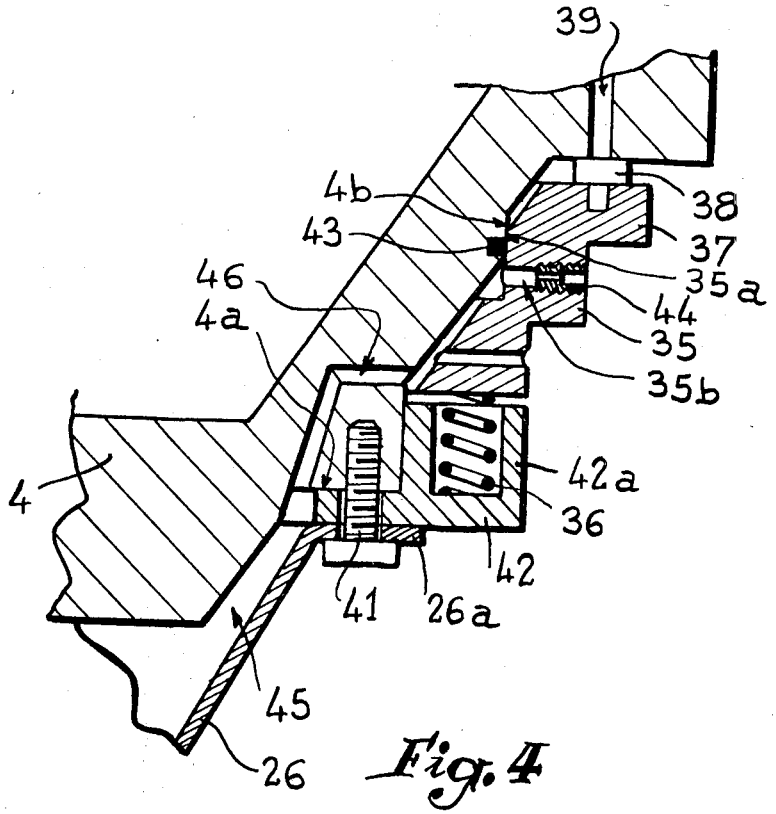
FIG. 4 is a detailed section on a large scale corresponding to part of the right-hand half of FIG. 2.

FIG. 4 shows this valve device in detail. The plate 26 comprises a peripheral edge **26*a* forming a flange which is fixed to the fixed base 4 by screws 41. These screws secure at the same time, against a transverse annular face 4*a* of this base, a piece 42 in the form of a flat ring whose periphery is provided with upwardly open sockets 42*a* which contain the springs 36 which act on the ring 35. The latter has an inner cylindrical surface 35*a* which slides on a corresponding cylindrical surface 4*b* at the periphery of the base 4, a seal 43 ensuring tightness. Below this seal, the wall of the ring 35 is pierced with a radial hole 35*b* containing a calibrated perforated insert 44. A bent channel 46 pierced in the wall of the base 4 leads from the annular space 45 which separates the plate 26 from the base 4 internally with respect to the flange 26*a*, said bent channel 46 opening in the bottom of the clearance made between the ring 42 and said base 4 below the cylindrical surfaces 4*b* and 35*a*. It will be noted that this clearance extends up to the entrance of hole 35*b***.

When the plate 26 collects liquid, the latter is delivered by rotational centrifugal force into the channel 46 from which it leaves in the form of a jet. This jet meets the inner truncated wall of the ring 35 and, still under the effect of the centrifugal force, it is repelled towards the hole **35*b* to escape through the calibrated insert 44. The latter allowing only a very low rate of flow, the liquid accumulates under pressure between the opening of the channel 46 and the hole 35*b*, so that it lowers the ring 35, compressing the springs 36 and thus opening the lower opening of the drainage channels 39**.

It will be understood that, when a suitable hydraulic control liquid is sent into the pipe 23, it reaches, through chamber 22, the ports 25 which act as openings of the pipe for conveying this liquid to the turbine system. The liquid arrives at the groove of member 14 which rotates it by the vanes 18. It passes through the passages 20, and through the channel 19 it arrives beneath the inner base 5 which it raises vertically in order to maintain it applied against the lower edge 33 (FIG. 2) of the lid 28, the pressure of this liquid being ensured by the centrifugal acceleration. When the base 5 is lifted, the flow through the channel 19 stops (except for leaks), the groove of member 14 is filled, the ports or openings 25 are immersed and, if the inlet pressure of the liquid through the pipe 23 is low, the counter-pressure which thus appears on the ports 25 stops the flow or, more exactly, limits it to the very low rate of flow necessary for compensating the inevitable leaks.

It is important to note that the liquid under pressure acts on the flange of the support 16 (FIG. 1) to urge it downwardly, therefore tending to wedge said support 16 on the conical bearing surface 2 of the shaft more tightly, thus preventing any angular slippage of the grooved member inside the housing of the bowl hub.

If the inlet pressure of the liquid through the pipe 23 is sufficiently increased, the groove of member 14 overflows. The excess liquid is collected by the plate 26 which guides it to the valve device where it lowers the ring 35 (FIG. 2) against the springs 36, thus uncovering the drainage ports 39. The channel 19 (FIG. 1) being of relatively small section, the control chamber located beneath the inner base 5 empties without the groove of member 14 ceasing to overflow and consequently the base 5 descends, uncovering the outlet ports 30 (FIG. 2) and thus enabling the sludge to be evacuated.

The functioning which has just been described is in accordance with that known in the prior art, for instance as shown in my U.S. Pat. No. 4,243,172. However, the invention differs therefrom in that the whole of the rotating unit (bowl and lid) may be dismantled from the machine without it being necessary to unscrew the ring 29 on the spot, this possibly presenting considerable difficulty when the threads have seized up under the effect of the expansions and contractions, the inevitable leaks of the centrifuged liquid or the control liquid, the infiltrations of fine sludge forming cement, etc. In the present structure, it suffices to unscrew the screw 8 with the aid of a socket wrench engaged through the upper central orifice of the centrifuge and through the tubular body 40 adapted to conduct the inlet of the liquid to be treated, then to withdraw this screw with the aid of a suitable tool (which may be the wrench itself) provided with a clip device cooperating with the impressions 10, and finally to use any pulling device abutting on the shaft to raise the bowl and the lid. By way of example, the bore of the cylindrical extension 7 may be threaded at a greater pitch than that of the bore of the shaft and a tommy having two corresponding threads may be used. However one operates, the lifting of the bowl is not hindered by the turbine system, or more exactly by the fact that the annular plate 24 cannot directly be disengaged from the groove of member 14 without prior dismantling of the member 14. In fact, the wedging of the support 16 on the conical bearing surface 2 normally retains the member 14 which then slips out of the large-diameter part 11 of the housing 11–12 and is therefore disengaged from the bowl unit. Even if this wedging were insufficient, the plate 24 would abut against the lower edge of the groove member and would ensure its disengagement from the housing.

FIG. 3 shows the centrifugal machine after the bowl and lid assembly has been removed from the top, the grooved member 14 remaining in position with its support 16 fitted on the bearing surface 2.

This possibility of direct dismantling of the movable bowl unit offer various advantages. Firstly, in the case of the ring 29 proving to be virtually impossible to unscrew on the spot, which occurs fairly frequently, said unit could nevertheless be taken to a workshop provided with more powerful means for achieving the removal of this ring, if necessary even by cutting. In the second place, when it is desired to clean, check or repair the bowl and its accessories, it is possible, if there is a spare bowl unit available, to assemble it in position whilst the first is being cleaned, the time when the machine is stopped thus being reduced to a minimum since no dismantling is required except for that of the screw 8. Finally, if it is desired to have access to the turbine system, it is no longer necessary to open the lid previcusly.

It will be understood that the turbine system could comprise a plurality of main receiving grooves such as the groove of the annular member 14 with a plate 24 associated with each of them, the chamber 22 then being replaced by a corresponding number of individual pipes. The or each grooved member may be fixed beneath the bowl in any manner other than that described, provided that their disengagement does not require the opening thereof. The turbine system could be used for conveying to the bowl a reaction, washing, phase detection, etc. liquid. The auxiliary overflow groove 45 could be constituted by a notch cut in the lower edge of the grooved member 14 and connected to the ring 35 by a suitable pipe. The general construction of the centrifuge may be different from that shown in FIG. 2, particularly concerning the bowl and its lid.

What is claimed is:

1. A centrifuge comprising:

(a) a frame supporting a rotating shaft having an annular support surface near its outer end;

(b) a sleeve supported by the frame and extending around the shaft adjacent to its support surface, the sleeve having ports extending radially therefrom, and the ports being coupled to a source of hydraulic control liquid whose pressure is adjustable;

(c) an annular member supported on said support surface and surrounding the sleeve in the vicinity of its radial ports, the annular member having an annular groove in its inner surface opening radially toward said ports and the groove having a bottom surface located away from said ports, and the annular member having passages extending from the bottom of the groove away from said ports;

(d) a bowl and lid unit comprising a base bowl having a central hub shaped to slide onto said support surface of the shaft and be supported thereby and having an enlarged housing portion shaped to overlie and removably seal to said annular grooved member, and the unit having an inner bowl within said base bowl and moveable axially of the shaft therein, and the unit having a lid supported by the base bowl and sealingly engaged by the inner bowl when the latter is moved toward the lid axially with respect to the shaft and the base bowl; and (e) first hydraulically controlled means operative to move the inner bowl into sealing engagement with the lid, and coupled with said passages extending from the bottom of the groove to receive liquid therefrom.

2. The centrifuge as claimed in claim 1, wherein said ports protrude from said sleeve and extend into the groove toward the bottom thereof, the sleeve having liquid channel means therein communicating with the ports and with said source of control liquid.

3. The centrifuge as claimed in claim 1, wherein said shaft support surface is conical, and said annular member lies on both sides of said ports and is separable into a first member carrying a seal to seal to the hub of the bowl unit and a second member removably secured to the first member and supported on the conical support surface of the shaft within said enlarged housing portion of the bowl.

4. The centrifuge as claimed in claim 3, wherein said enlarged housing portion of the hub has a surface overlying the first portion of the annular member and defining a space therebetween, the passages from the bottom of the groove opening into said space and the space being coupled with said first hydraulically controlled means.

5. The centrifuge as claimed in claim 1, further comprising second hydraulically controlled means operative to move the inner bowl out of sealing engagement with said lid; and the bowl unit having an auxiliary liquid collecting groove coupled to said second hydraulically controlled means and located adjacent to said groove in the annular member to collect liquid overflowing from the latter groove when the pressure from the liquid source is increased.

6. The centrifuge as claimed in claim 5, wherein said auxiliary liquid collecting unit is defined by an outer surface of the bowl and by a plate fixed in spaced relationship to said outer surface of the bowl and having a central aperture of diameter greater than the outside diameter of the annular member to permit removal of the bowl unit from the shaft while the annular member remains fixed theron.

* * * * *